United States Patent [19]

Hansen et al.

[11] 3,953,061

[45] Apr. 27, 1976

[54] DOOR FASTENING MEANS

[75] Inventors: Randall C. Hansen, Lake Forest; Kenneth J. Miller, Gurnee, both of Ill.

[73] Assignee: A. L. Hansen Mfg. Co., Gurnee, Ill.

[22] Filed: Sept. 23, 1974

[21] Appl. No.: 508,432

[52] U.S. Cl. ..... 292/5; 292/34; 292/36

[51] Int. Cl.[2] ..... E05C 5/00; E05C 1/06

[58] Field of Search ..... 292/5, 3, 34, 36

[56] References Cited

UNITED STATES PATENTS

| | | | |
|---|---|---|---|
| 140,307 | 6/1873 | Rand | 292/36 |
| 271,867 | 2/1883 | Kirby, Jr. | 292/36 |
| 1,984,425 | 12/1934 | Peelle | 292/36 |
| 2,069,883 | 2/1937 | Hennicke | 292/5 |
| 2,169,692 | 8/1939 | Hansen | 292/5 |
| 2,449,074 | 9/1948 | Kealy | 292/34 |
| 2,729,089 | 1/1956 | Pelcin | 292/36 |
| 3,025,693 | 3/1962 | Braginetz | 70/99 |
| 3,052,493 | 9/1962 | Hawver et al. | 292/36 |

FOREIGN PATENTS OR APPLICATIONS

| | | | |
|---|---|---|---|
| 867,811 | 1/1953 | Germany | 292/5 |
| 1,184,157 | 3/1970 | United Kingdom | 292/5 |

*Primary Examiner*—Casmir A. Nunberg
*Assistant Examiner*—Victor N. Sakran
*Attorney, Agent, or Firm*—Johnson, Dienner, Emrich & Wagner

[57] ABSTRACT

A rotatable cam disc has connected thereto linkage means for operating latch bolts. The cam disc has an arcuate cutout in the edge portion thereof defining a pair of end shoulders. A lock actuator plate is rotatable coaxially of the cam disc, and has secured thereto a post member movable within the cam disc cutout. Upon rotation of the lock plate actuator, the post member is engageable with an end shoulder of the cam disc for effecting rotation of the latter and actuation of the linkage means.

7 Claims, 7 Drawing Figures

48
58
62
104
60
64
56
62
58
104
102
90
7.
100
92
7.
100
98
96
86
94
76
78
6.
72
82
82
74
80
82
84
52
6.
66
68
68
88
69
50
54
46

DOOR FASTENING MEANS

FIELD OF THE INVENTION

The present invention relates generally to door fastening means adapted for use, for example, with the rear doors of enclosed transport vehicles or highway trailers.

SUMMARY OF THE INVENTION

The lock actuating means of the present invention is especially adapted for use with a door frame having upper and lower elements, a door having a vertical edge hinged to the frame, keeper members secured to the upper and lower elements of the frame, spring biased latch bolts carried by the door and engageable with the keeper members, and toggle bars connected at their one ends to the latch bolts.

The lock actuating means comprises a cam disc rotatably carried by the door and having an arcuate cutout in the edge portion thereof defining a pair of end shoulders. Means connect the other ends of the toggle bars to the cam disc at diametrically opposed locations. A lock actuator plate is rotatably carried by the door coaxially of the cam disc, and a post member, secured to the lock actuator plate, is movable within the cam disc cutout. Upon rotation of the lock actuator plate, the post member is engageable with an end shoulder of the cam disc for effecting rotation of the latter and actuation of the toggle bars.

DESCRIPTION OF THE PREFERRED EMBODIMENT

Figure 1:
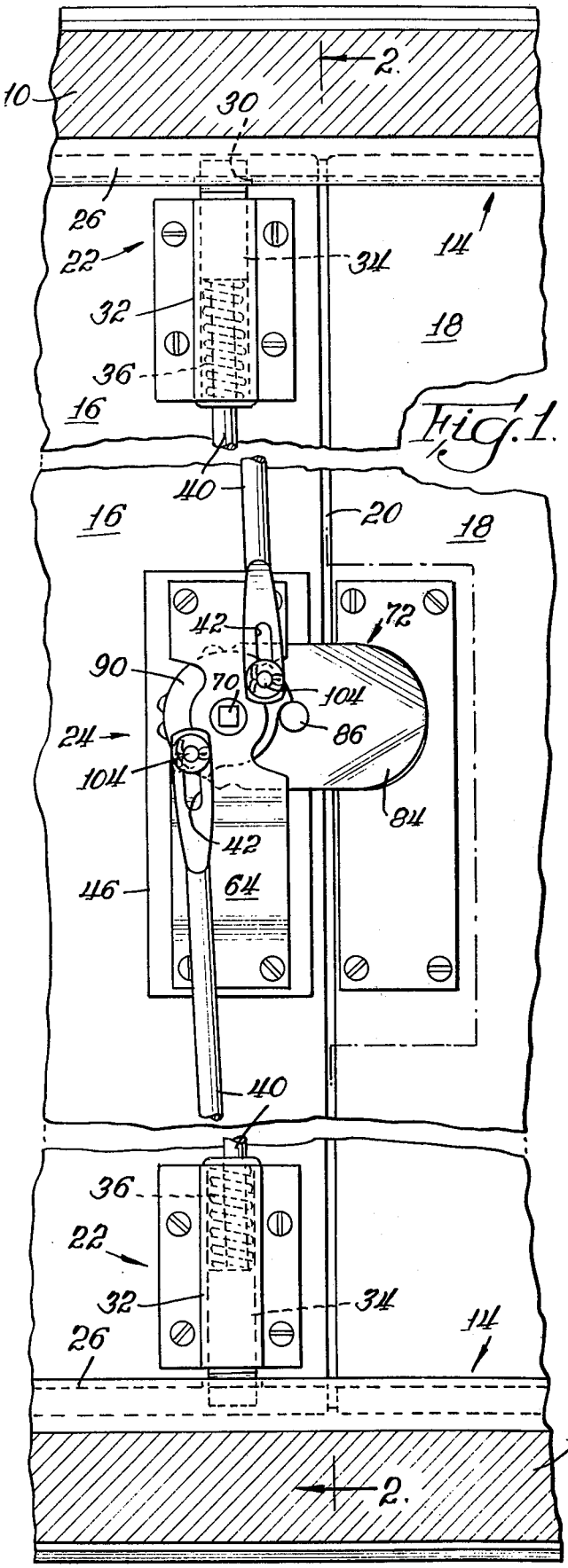
FIG. 1 is a fragmentary elevational view of a door frame and a pair of doors with which are incorporated door fastening means embodying the principles of the present invention.
Figure 2:
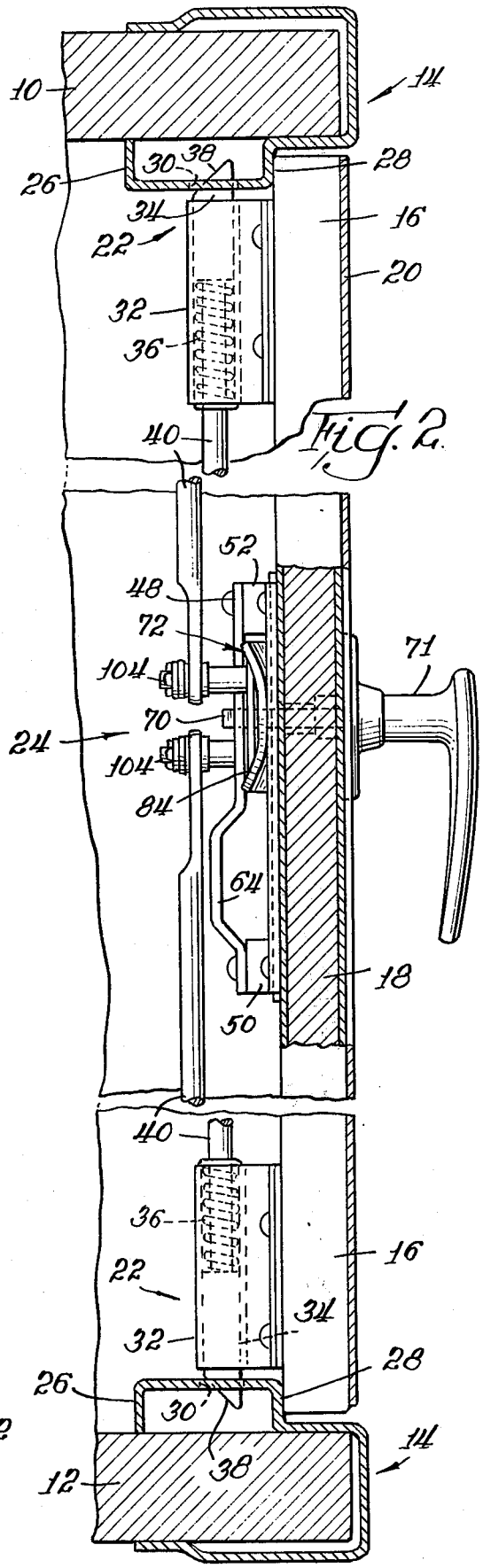
FIG. 2 is a fragmentary sectional view taken substantially along the line 2—2 in FIG. 1 looking in the direction indicated by the arrows.

Referring now to FIGS. 1 and 2, there are shown fragmentary portions 10 and 12 of the upper and lower horizontal structural elements, respectively, of a conventional door frame, indicated generally by the reference numeral 14, which may, for example, be located at the rear end of the body of an enclosed transport vehicle. Suitably hinged along their one vertical edges to the vertical sides (not shown) of the door frame 14 are a pair of doors 16 and 18 which are arranged to be swung into the plane of the door frame 14 with their free vertical edges being disposed in substantial abutting relation for closing the opening defined by the frame 14. Secured to the front face of the door 16 and projecting therefrom along the vertical free edge thereof is an overlap strip 20 which is engageable with the vertical free edge of the door 18 for preventing outward swinging movement of the door 18 when the doors 16 and 18 are within the plane of the door frame 14.

Door fastening means are associated with the doors 16 and 18 and the structural elements 10 and 12 for selectively interconnecting the same whereby to retain the doors 16 and 18 within the plane of the door frame 14. The door fastening means includes conventional top and bottom locking means 22, and novel center locking and lock actuating means 24 embodying the principles of the present invention.

The top and bottom locking means 22 comprises a pair of keeper members 26 suitably secured to the upper and lower structural elements 10 and 12. Each keeper member 26 is formed with a vertical elongated abutment wall 28 and a vertical opening 30. A pair of vertical guide members 32 are suitably secured to the inner face of the door 16 adjacent the top and bottom corners thereof. Slidably mounted in each guide member 32 is a latch bolt 34 biased outwardly by a coil spring 36. The latch bolts 34 are formed with outer beveled ends 38 which, during closing movement of the door 16, ride over the keeper walls 28 and into engagement with the keeper openings 30. A pair of toggle bars 40 at their one ends are connected to the inner ends of the latch bolts 34, and at their other ends are formed with elongated lost-motion slots 42.

Figure 3:
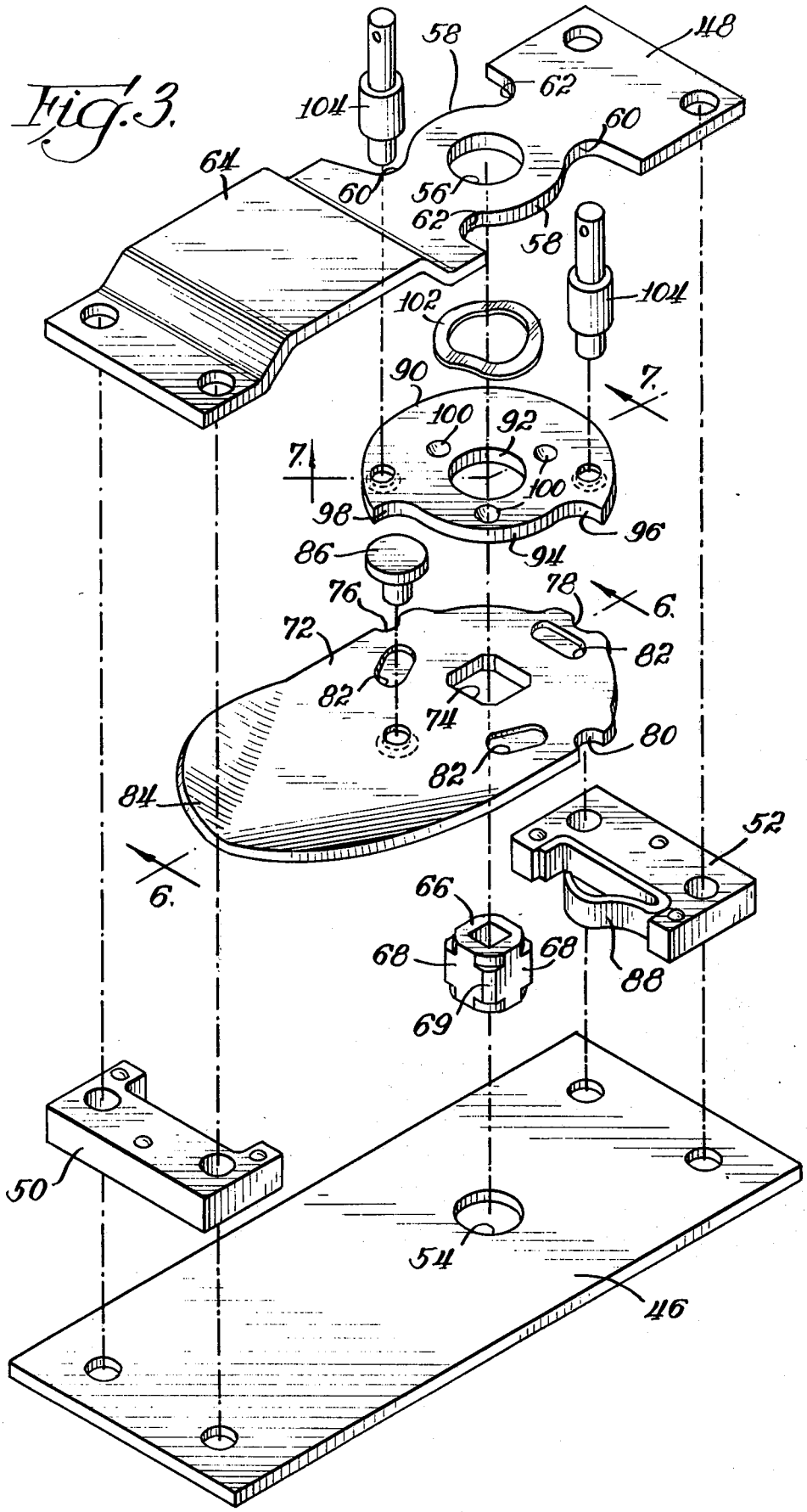
FIG. 3 is an enlarged exploded perspective view of the center locking and lock actuating means of the present invention.

As best shown in FIG. 3, the center locking and lock actuating means 24 comprises inner and outer plate members 46 and 48 separated by spacer blocks 50 and 52, which in assembled relation define casing means. The inner plate member 46 is formed with an intermediate aperture 54, and is suitably secured to the inner face of the door 16. The outer plate member 48 is formed with an intermediate aperture 56, with opposed arcuate edge cutouts 58 concentric of the aperture 56 and defining pairs of end shoulders 60 and 62, and with an outwardly offset wall section 64.

Rotatably mounted in the casing apertures 54 and 56 is a spindle bushing 66 having exterior intermediate flat walls 68 and arcuate corners 69. The spindle bushing 66 is formed with a non-circular axial bore which receives the non-circular shaft 70 of an operating handle 71 mounted at the outer face of the door 16 (FIG. 2).

A lock actuator plate 72 is arranged between the plate members 46 and 48 for rotation with the spindle bushing 66 and is formed with an opening 74 which fits about the spindle bushing 66 and corresponds to the cross sectional configuration of the walls 68 and corners 69 thereof. The lock actuator plate 72 is also formed with edge detent notches 76, 78 and 80 spaced 90° apart, and with offset bearing pads 82 spaced 120° apart. The lock actuator plate 72 further includes a lock tongue section 84 which is rotatable through the area beneath the offset wall section 64, and has secured therein a post member 86. A leaf spring 88 is secured to the spacer block 52, and is engageable with the edge detent notches 76, 78 and 80 for releasably locating the lock actuator plate 72 in one of three rotative positions.

A cam disc 90 is arranged between the lock actuator plate 72 and the outer plate member 48. The cam disc 90 is formed with a central circular opening 92 which fits about the spindle bushing 66 and corresponds to the circumference of the corners 69 thereof, whereby the cam disc 90 and spindle bushing 66 are rotatable relative to each other. The cam disc 90 is also formed with an arcuate edge cutout 94 concentric of the opening 92 and defining a pair of end shoulders 96 and 98, and with inwardly offset bearing dimples 100 spaced 120° apart. A wave washer 102 is interposed between the outer plate member 48 and the cam disc 90 for biasing the bearing dimples 100 against the lock actuator plate 72 and for biasing the bearing pads 82 against the inner plate member 46. The post member 86 of the lock actuator plate 72 is movable within the cam disc cutout 94 between the end shoulders 96 and 98. A pair of stud members 104 are secured at their inner ends in the cam disc 90 at diametrically opposed locations and are movable within the outer plate member cutouts 58 between the end shoulders 60 and 62. The outer ends of the stud members 104 are fastened in the lost-motion slots 42 of the toggle bars 40 (FIG. 1).

The elements of the door fastening means disclosed herein are shown in a full locked position in FIGS. 1 and 2. The latch bolts 34 are engaged in the keeper openings 30, while the lock tongue section 84 is engaged behind the door 18.

Figure 4:
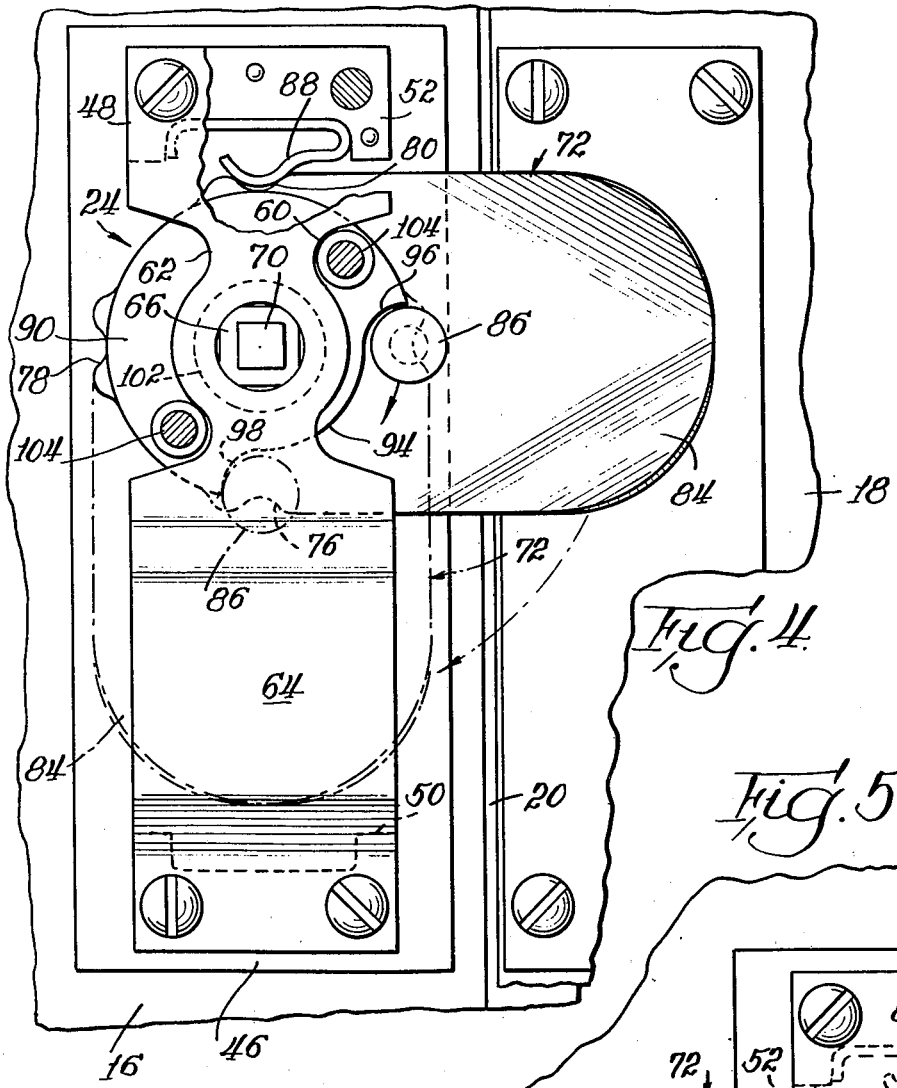
FIG. 4 is an enlarged elevational view of the center locking and lock actuating means in a full locked position shown in solid lines and in a partial locked position shown in dotted lines.
Figure 6:
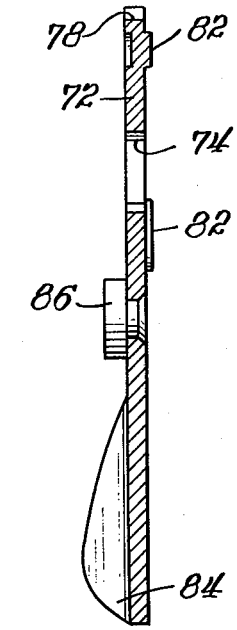
FIG. 6 is a sectional view taken substantially along the line 6—6 in FIG. 3 looking in the direction indicated by the arrows.
Figure 5:
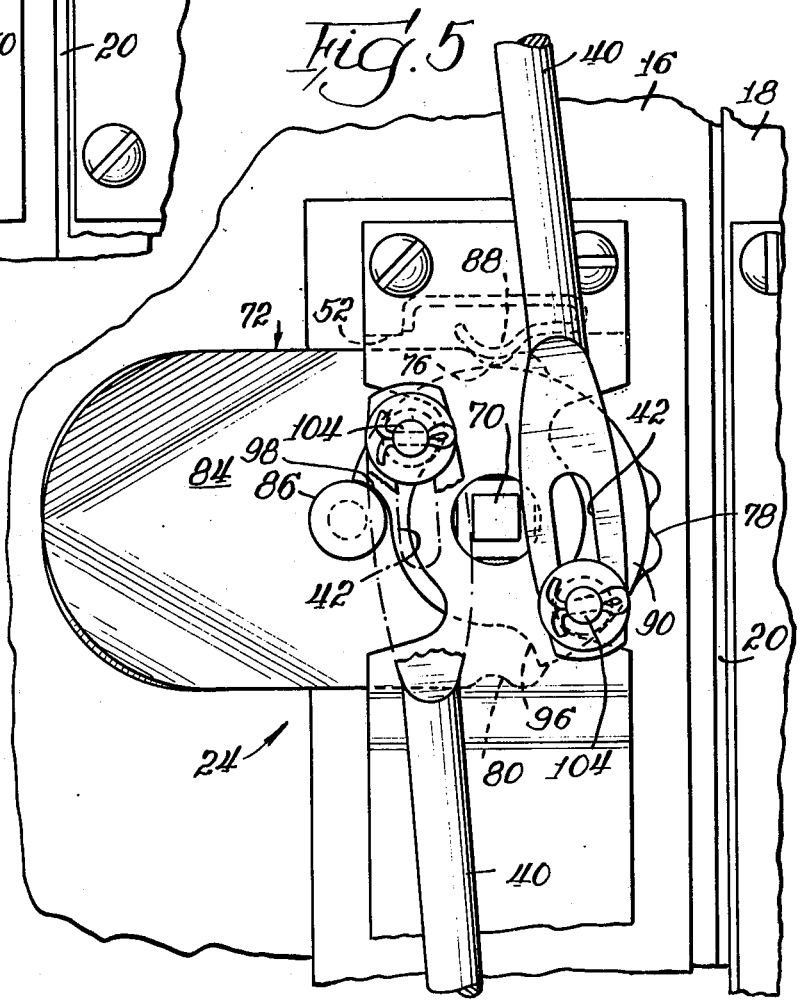
FIG. 5 is an enlarged elevational view of the center locking and lock actuating means in a full unlocked position.
Figure 7:
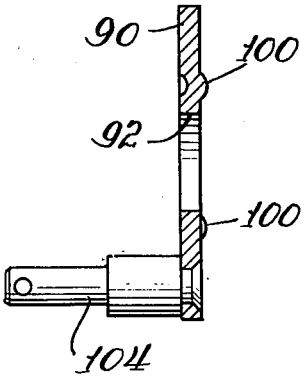
FIG. 7 is a sectional view taken substantially along the line 7—7 in FIG. 3 looking in the direction indicated by the arrows.

To release the door fastening means, the lock actuator plate 72 is rotated 180°, by the handle 71, from the position shown in FIGS. 1 and 4 to the position shown in FIG. 5. As the lock actuator plate 72 pivots through the first stage from the solid-line position to the dotted-line position shown in FIG. 4, the lock tongue section 84 is disengaged from the inner face of the door 18, and the post member 86 is moved within the cutout 94 from the shoulder 96 to the shoulder 98. Then, as the lock actuator plate 72 pivots through the second stage from the dotted-line position shown in FIG. 4 to the position shown in FIG. 5, the post member 86 engaging the shoulder 98 pivots the cam disc 90 from the position shown in FIG. 4 to the position shown in FIG. 5, and the stud members 104 are moved within the cutouts 58 from the shoulders 60 to the shoulders 62 whereby the upper and lower toggle bars 40 are drawn, respectively, downwardly and upwardly. During this movement of the toggle bars 40, the latch bolts 34 are withdrawn from engagement with the keeper members 26 permitting the doors 16 and 18 to be opened. The lock actuator plate 72 is releasably held in a fully unlocked position by reason of engagement of the spring 88 with the edge detent notch 76.

To condition the door fastening means for locking while the door 16 is in an open position, the lock actuator plate 72 (together with the post member 86) is rotated 90°, by the handle 71, from the position shown in FIG. 5 to the dotted-line position shown in FIG. 4. Also, the latch bolt springs 36 push the latch bolts 34 outwardly whereby the upper and lower toggle bars 40 are drawn, respectively, upwardly and downwardly. During this movement of the toggle bars 40, the stud members 104 are caused to move within the cutouts 58 from the shoulders 62 to the shoulders 60, and the cam disc 90 is rotated from the position shown in FIG. 5 to the position shown in FIG. 4. The lock actuator plate 72 is releasably held in its intermediate position by reason of engagement of the spring 88 with the edge detent notch 78.

Upon closing of the door 16 with the strip 20 overlapping the closed door 18, the outer beveled ends 38 of the latch bolts 34 ride over the keeper walls 28 and into engagement with the keeper openings 30 for partially locking the doors 16 and 18 in closed position. The toggle bar slots 42 accommodate movement of the toggle bars 40 relative to the stud members 104 during engagement of the latch bolts 34 with the keeper members 26.

With the doors 16 and 18 closed and partially locked, the lock actuator plate 72 (together with the post member 86) is rotated 90°, by the handle 71, from the dotted-line position to the solid-line position shown in FIG. 4. The elements of the door fastening means are then again in a full locked position. The lock actuator plate 72 is releasably held in a locked position with the lock tongue section 84 engaged behind the door 18 by reason of engagement of the spring 88 with the edge detent notch 80.

If desired, the doors 16 and 18 may be first closed, and then locked by rotating the lock actuator plate 72 in a substantially continuous movement from the position shown in FIG. 5 to the solid-line position shown in FIG. 4. By reason of the symmetry of the operating components of the center locking and lock actuating means 24, the assembly may be mounted in either a right-hand or a left-hand orientation.

While there has been shown and described a preferred embodiment of the present invention, it will be understood by those skilled in the art that various rearrangements and modifications may be made therein without departing from the spirit and scope of the invention.

The invention claimed is:

1. For use with a door frame having upper and lower elements, a door having a vertical edge hinged to the frame, keeper members secured to the upper and lower elements of the frame, spring biased latch bolts carried by the door and engageable with the keeper members, and toggle bars connected at their one ends to the latch bolts, the combination of a cam disc rotatably carried by the door and having an arcuate cutout in the edge portion thereof defining a pair of end shoulders, connecting means connecting the other ends of the toggle bars to said cam disc at diametrically opposed locations thereon, a lock actuator plate rotatably carried by the door coaxially of said cam disc, a post member secured to said lock actuator plate and movable within said cam disc cutout, and actuator means operatively connected to said actuator plate to rotate the same between a first unlocked position wherein the latch bolts are disengaged from the keeper members, a second intermediate position wherein said post member on said actuator plate upon rotation of said lock actuator plate engages an end shoulder of said cam disc to rotate the same thereby effecting movement of the toggle bars and the latch bolts into engagement with the keeper members and a third fully locked position wherein said actuator plate projects laterally above the door frame.

2. The combination of claim 1 including a casing, and a spindle bushing rotatably mounted in said casing; and wherein said cam disc is rotatably mounted on said spindle bushing, and said lock actuator plate is mounted on said spindle bushing for rotation therewith.

3. The combination of claim 2 wherein said lock actuator plate is formed with at least one edge detent notch; and including spring means carried by said casing and engageable with said edge detent notch for releasable locking said actuator plate in predetermined first unlocked second intermediate locked or third fully locked positions.

4. The combination of claim 1 including a casing having an inner plate member secured to the door and an outer plate member spaced therefrom, a spindle bushing rotatably mounted in said inner and outer plate members, and said outer plate member being formed with opposed arcuate edge cutouts concentric of said spindle bushing and defining pairs of end shoulders; and wherein said cam disc is rotatably mounted on said spindle bushing, said lock actuator plate is mounted on said spindle bushing for rotation therewith, and said connecting means is comprised of a pair of stud members secured in said cam disc and movable within said cutouts of said outer plate member.

5. The combination of claim 4 wherein said lock actuator plate includes a lock tongue section disposable to project laterally of the door when in said third fully locked position, wherein said lock tongue section is moved from said third locked position upon rotation of said lock actuator plate through a second intermediate locked stage while said post member moves within said cam disc cutout, and wherein said post member upon rotation of said lock actuator plate through a first unlocked stage engages an end shoulder of said cam disc and effects rotation of the latter for withdrawing the latch bolts from engagement with the keeper members.

6. The combination of claim 1 wherein said connecting means is comprised of lost-motion connecting means accommodating movement of the toggle bars relative to said cam disc, said lock actuator plate includes a lock tongue section disposable to project laterally of the door when in said third locked position, wherein said locked tongue section is moved from said third locked position upon rotation of said lock actuator plate through a second intermediate locked state while said post member moves within said cam disc cutout, and wherein said post member upon rotation of said lock actuator plate through a first unlocked stage engages an end shoulder of said cam disc and effects rotation of the latter for withdrawing the latch bolts from engagement with the keeper members.

7. The combination of claim 6 wherein said lock actuator plate is formed with three circumferentially spaced apart edge detent notches; and including spring means carried by the door and engageable with the individual edge detent notches for releasably locating said lock actuator plate in any one of three rotative positions.

* * * * *